US008257111B1

(12) United States Patent
Smutny et al.

(10) Patent No.: US 8,257,111 B1
(45) Date of Patent: Sep. 4, 2012

(54) SEALED ELECTRICAL SPLICE ASSEMBLY

(75) Inventors: Dale J. Smutny, Canfield, OH (US); Wesley W. Weber, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/039,614

(22) Filed: Mar. 3, 2011

(51) Int. Cl.
*H01R 13/40* (2006.01)

(52) U.S. Cl. ..... 439/511; 439/587; 439/752

(58) Field of Classification Search ..... 439/511, 439/587, 752, 507, 512
See application file for complete search history.

(56) References Cited

U.S. PATENT DOCUMENTS

| | | | | |
|---|---|---|---|---|
| 4,186,986 | A | 2/1980 | Shoemaker | |
| 4,944,688 | A * | 7/1990 | Lundergan | 439/275 |
| 5,431,758 | A | 7/1995 | Delalle | |
| 5,782,658 | A * | 7/1998 | Maegawa et al. | 439/595 |
| 6,193,549 | B1 * | 2/2001 | Suzuki et al. | 439/589 |
| 6,447,331 | B1 * | 9/2002 | Fukatsu et al. | 439/516 |
| 6,692,303 | B2 * | 2/2004 | Fukatsu | 439/595 |
| 6,818,829 | B1 | 11/2004 | McMillan et al. | |
| 7,278,890 | B1 | 10/2007 | Smutny et al. | |
| 7,481,675 | B2 * | 1/2009 | Patterson et al. | 439/587 |
| 2003/0054690 | A1 * | 3/2003 | Fukatsu | 439/595 |
| 2007/0246241 | A1 | 10/2007 | Peterson et al. | |

* cited by examiner

*Primary Examiner* — Gary F. Paumen
(74) *Attorney, Agent, or Firm* — Paul W. Thiede

(57) ABSTRACT

A sealed electrical splice assembly includes a housing defining a cavity and including an opening. A conductive bus plate is retained in the cavity. A plurality of electrically conductive terminals are received in the cavity are electrically connected to the bus plate. The plurality of terminals are connected to a plurality of wire conductors. A seal plug is disposed in the cavity through the opening adapted to sealingly engage an interior surface of the housing surrounding the seal plug. An end cover overlies the seal plug disposed in the opening. The cavity receives the plurality of terminals through the end cover and the seal plug thereby allowing the seal plug to sealingly engage the plurality of wire conductors.

18 Claims, 4 Drawing Sheets

SEALED ELECTRICAL SPLICE ASSEMBLY

RELATED DOCUMENTS TO APPLICATION

This application is related to U.S. Application U.S. Ser. No. 12/723,741 filed 15 Mar. 2010 having the title "SPLICE ASSEMBLY", which is co-owned by the assignee of this application, and incorporated by reference herein.

TECHNICAL FIELD

This invention relates to electrical splice assemblies used in cable harnesses.

BACKGROUND OF INVENTION

It is known to use joint connectors, for example, in automotive splice applications in which a centralized connector is needed to connect one or more main wire cables to a plurality of branching wire cables.

Such joint connectors typically comprise many component parts, such as a housing, terminals, bus bars, a cover, and the like. Consequently, such joint connectors may be complicated, expensive to manufacture, and bulky, making them difficult to package in some applications. Joint connectors may also be required to be disposed in automotive applications where exposure to environmental elements such as water, dirt, and corrosive elements, is commonplace.

Thus, a need remains then, such as in vehicle electrical systems incorporating a decentralized splicing arrangement, for a reliable, light weight, low-cost and compact sealed electrical splice assembly.

SUMMARY OF THE INVENTION

In accordance with one embodiment of the invention, a sealed electrical splice assembly includes a housing defining a cavity and including an opening. A conductive bus plate is retained in the cavity. A plurality of electrically conductive terminals are received in the cavity are electrically connected to the bus plate. A seal plug is disposed in the cavity through the opening adapted to sealingly engage an interior surface of the housing surrounding the seal plug. An end cover overlies the seal plug disposed in the opening. The cavity receives the plurality of terminals through the end cover and the seal plug thereby allowing the seal plug to sealingly engage the plurality of wire conductors connected with the plurality of terminals and the end cover to mechanically secure the plurality of wire conductors to the housing.

In accordance with another embodiment of the invention, a method to install a sealed electrical splice assembly to a cable harness is provided. One step in the method is inserting a plurality of terminals associated with the cable harness in to a cavity of the sealed splice assembly. The plurality of terminals electrically connect to a common electrically conductive bus plate in the cavity and the plurality of terminals are attached to a plurality of wire conductors. A seal plug is sealingly engaged against an interior surface of the housing surrounding the seal plug disposed in the cavity. Another step in the method is sealingly engaging the plurality of wire conductors with the seal plug when the plurality of terminals are disposed in the cavity.

In yet another embodiment of the invention, a sealed electrical splice assembly includes an insulative housing having longitudinally extending side walls with a floor and top wall extending therebetween and ends that combine to define a cavity. One of the ends is a closed end and another one of the ends is an open end. The housing includes an end cover overlying the open end, a seal plug disposed in the cavity adjacent the end cover, a conductive bus plate disposed in the cavity, a plurality of terminals in electrical connection with a plurality of wire conductors where the plurality of terminals are received in the cavity are in electrical connection with the bus plate, and a flexible lock secures the received plurality of terminals in the cavity therein.

BRIEF DESCRIPTION OF THE DRAWINGS

This invention will be further described with reference to the accompanying drawings in which.

DETAILED DESCRIPTION OF THE EMBODIMENTS

Figure 1:
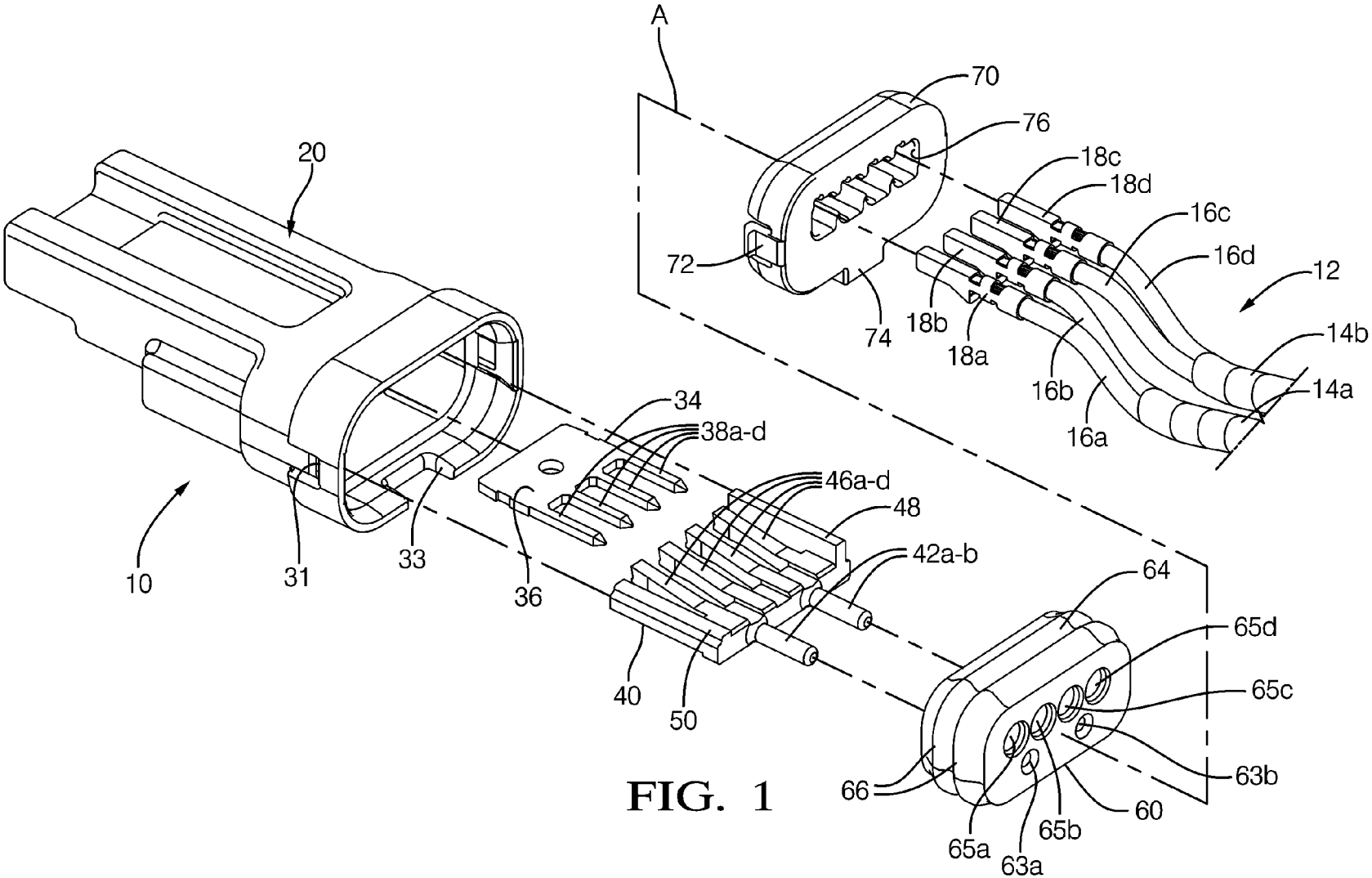
FIG. 1 shows a exploded view of an sealed electrical splice assembly in connection to a cable harness according to the invention.
Figure 2:
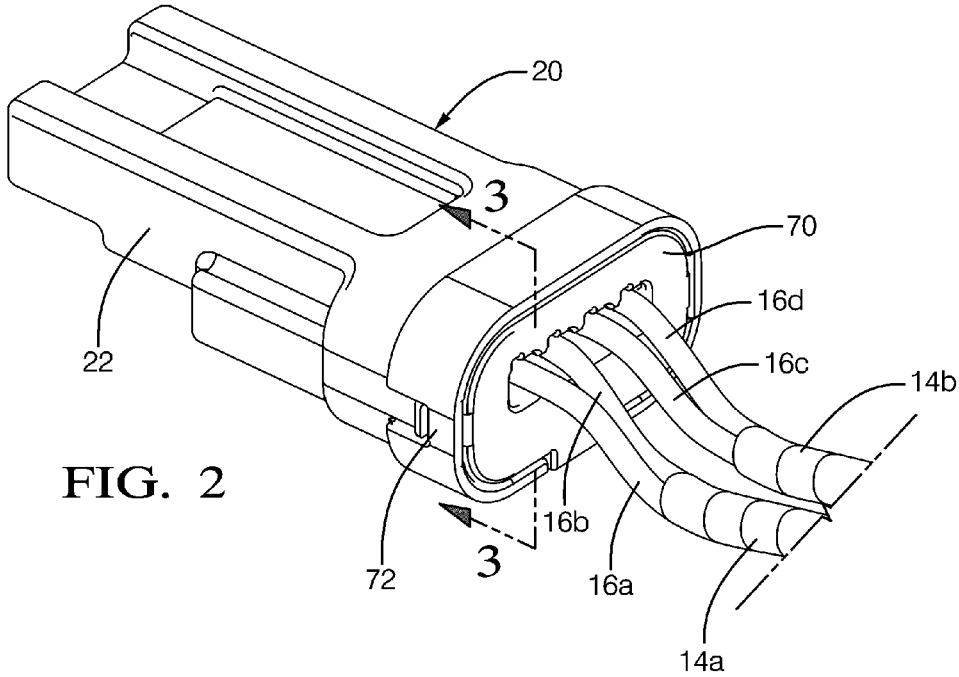
FIG. 2 shows a perspective view of an assembled sealed splice assembly of FIG. 1.

Referring to FIGS. 1 and 2, in accordance with the embodiments of this invention, a sealed electrical splice assembly 10 is used in the manufacture of a cable harness 12. Cable harness 12 electrically connects together electrical components disposed in a vehicle (not shown). Cable harness 12 includes a pair of branch cables 14*a*, 14*b*. Each respective branch cable 14*a*, 14*b* includes wiring assemblies having electrical connections. The wiring assemblies include a plurality of wire cables, or conductors 16*a-d* being connected to a plurality of corresponding electrically conductive female box terminals 18*a-d*. Female terminals 18*a-d* are inserted in assembly 10 along a mating axis A so that assembly 10 is used to electrically connect an electrical signal carried on one wire conductor of wire conductors 16*a-d* of cable harness 12 to the other remaining wire conductors disposed in assembly 10. For example and not limitation, the electrical signal on wire conductor 16*a* and terminal 18*a* may be electrically conducted to terminals 18*b-d* and wire conductors 16*b-d*. Further, the sealed splice assembly may be effectively used to facilitate power distribution or electrical ground distribution in the cable harness. Terminals 18*a-d* are constructed of a metal material, preferably a tin-plated copper alloy. Alternately, the sealed splice assembly may be constructed to fit other types of female terminals.

Assembly 10 is suitable for an operating environment exposed to environmental elements, such as moisture, dust, dirt, and corrosive elements, such as is found, for example, in a vehicle application. In other embodiments, the vehicle application may beyond cars to trucks, airplanes, locomotives, airplanes, and the like. In any of these product applications, more than one electrical splice assembly may be utilized in each vehicle unit wherever they are needed.

Assembly 10 protects the electrical connections from these environmental elements where the electrical connections are defined as exposed conductor core leads on wire conductors 16*a-d* being attached, or connected to female terminals 18*a-*18*d*. The exposed leads of wire conductors 16*a-d* and terminals 18*a-d* are disposed within a sealed cavity 28 of assembly 10 as further described herein. The exposed core leads of the wire conductors 16*a-d* may be connected to the associated terminals 18*a-d* by crimping as is known in the connection and wiring art. Wire conductors 16*a-d* have an insulated, non-electrically conductive portion of wire conductors that surround the exposed core leads as is also known in the connection and wiring art. As shown in FIG. 1, assembly 10 is a four-way sealed splice assembly in that four female terminals are inserted into cavity 28 of assembly 10. Preferably, wire conductors 16*a-d* have the same American Wire Gauge (AWG) size to fit assembly 10.

Figure 3:
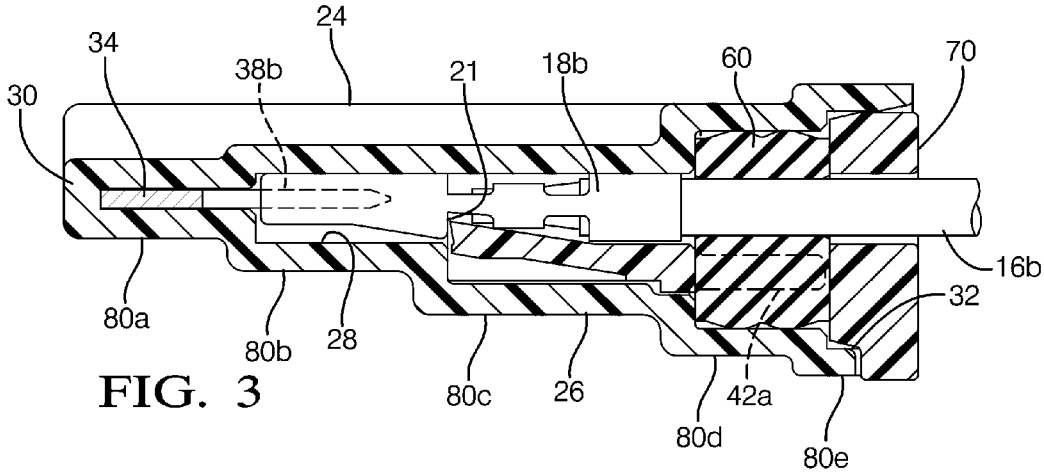
FIG. 3 shows a cross section view of the sealed splice assembly of FIG. 2 taken along the lines 3-3.
Figure 4:
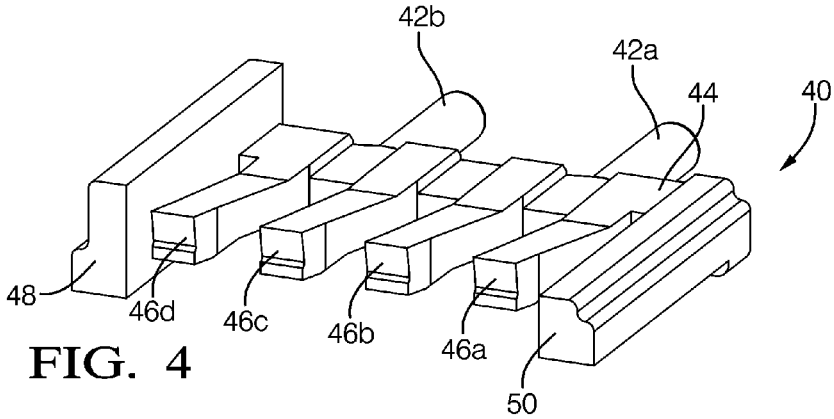
FIG. 4 shows a perspective view of a flexible lock of the sealed electrical splice assembly of FIG. 1.

Referring to FIGS. 1-3, assembly 10 includes an insulative, non-electrically conducting housing 20. Housing 20 includes a pair of laterally, opposingly spaced sidewalls 22, a top wall 24, and a floor 26. Top wall 24 and floor 26 are disposed between sidewalls 22 to define a cavity 28. One end of housing 20 is a closed end 30 and the other end of housing 20 opposite closed end 30 is an open end, or opening 32. Opening 32 has an oval shape. Alternately, the opening of the assembly may be any shape. Housing 20 of is formed of a plastic material, such as polyester, polypropylene, and nylon. Housing 20 further includes terminal portions 29*a-d* formed along top wall 24 and floor 26 along the interior surface of housing 20. Terminal portions 29*a-d* assist to guide the inserted terminals 18*a-d* into cavity 28. A keyed housing recess 33 notched into housing 20 is disposed adjacent opening 32.

An electrically conductive, planar bus plate 34 is adapted to fit into housing 20 and is retained in cavity 28 adjacent closed end 30. Bus plate 34 is formed of a metal material. Preferably, bus plate 34 may be formed of a tin-plated copper alloy. Bus plate 34 includes a strip 36. A plurality of cantilevered, spaced extensions 38*a-d* extend from strip 36 into cavity 28 towards opening 32. Extensions 38*a-d* are male blades that mate to the received female terminals 18*a-d*. Extensions 38*a-d* and strip 36 ensure a common electrical connection for any of female terminals 18*a-d* that connect with extensions 38*a-d*. Terminal portions 29*a-d* ensure female terminals 16*a-d* remain in proper alignment to be received by extensions 38*a-d*. In one embodiment, a 3-7 Newton pull-out force may be needed to overcome the retention force created by a female terminal mated with a male blade of the bus plate in the sealed splice assembly. Cavity 28 adjacent closed end 30 is sized to allow a press fit of bus plate 34 to be secured into cavity 28, preferably along the width of cavity 28. Alternately, the bus plate may be secured in the cavity at the closed end by being press fit along the height. Still yet alternately, the housing of the sealed splice assembly may be molded around the bus plate.

Referring to FIGS. 1, 3, 4, 5*a*, and 5*b*, a flexible lock 40 is disposed in nested portions 82 in cavity 28 and is adapted to secure and retain terminals 18*a-d* received in cavity 28. Flexible lock 40 may be formed from a non-electrical, dielectric plastic material such as reinforced polyester that may provide a higher retention force for flexible lock 40 to retain terminals 18*a-d* in cavity 28 without terminals 18*a-d* being pulled out from assembly 10. Flexible lock 40 includes at least one axially extending post 42*a-b* depending away from a base, or strip 44 of lock 40 towards opening 32. Lock 28 also includes a plurality of longitudinal flexible lock extensions 46*a-d* depending away from strip 44 towards bus plate 34. When lock 40 is installed in cavity 28, extensions 46*a-d* inwardly extend, or face towards cavity 28 and engage a recess 19 in female terminal 18*b*, as shown in FIG. 3. Each extension in plurality of extensions 46*a-d* is configured to engage with, and independently retain a female terminal being disposed in recess 21 disposed in each female terminal in plurality of female terminals 18*a-d* received in cavity 28. Referring to FIG. 5, flexible lock 40 further includes a first and a second longitudinal extending wall 48, 50 having differing heights so that flexible lock 40 is fitted through opening 32 and disposed in the corresponding height nested portions 82 in cavity 28 of housing 20 in a single orientation. First wall 48 has a larger height than second wall 50. Lock 40 is secured in cavity 28 by a combination of the disposition of first and second extending wall 48, 50, a resilient seal plug 60 disposed in cavity 28 and an end cover 70 being secured overlying opening 32 to housing 20. Hence, end cover 70 being secured to housing 20 is useful to retain lock 40 and seal plug 60 in assembly 10 and also provide mechanical strain relief for terminals 18*a-d* and wire conductors 16*a-d* disposed in assembly 10. End cover 70 is formed of a non-electrical, dielectric material such as polyester and nylon. The structures of housing 20, lock 40, and end cover 70 are generally more rigid than the structure of resilient seal plug 60. Laterally-spaced tabs 72 on end cover 70 axially align with, and engage shoulders 31 disposed on an external surface of housing 20 to secure end cover 70 with housing 20. Shoulders 31 are laterally spaced apart on housing 20. End cover 70 includes an extending cutout 74 that is received into a corresponding keyed housing recess 33 adjacent opening 32 in housing 20 so that end cover 70 is keyed to fit to housing 20 in a single orientation. End cover 70 is secured to housing 20 which enables a higher retention force to be realized before secured female terminals 16*a-d* are disengageable from cavity 28 of sealed splice assembly 10. For example, in one alternate embodiment, at least a 40 Newton force is needed to physically remove one secured female terminal from the sealed splice assembly with the end cover secured to the housing. A higher force may be required to also further remove the end cover. In contrast, the retention force of a female terminal attached to a male blade is a 3-7 Newton force, as previously described herein. Flexible lock 40 is fitted into cavity 28 being secured in cavity 28 by a combination of the disposition of extending walls 48, 50 of flexible lock 40 being structurally nested in housing 20 and being in contact with the interior wall of the housing 20, seal plug 60 disposed in cavity 28, and end cover 70 overlying seal plug 60 and secured to housing 20.

The choice of the materials used for the housing, the flexible lock, and the end cover depend on the environment of the application where the sealed splice assembly is disposed and the performance specifications that the sealed splice assembly may be required to meet. For example, in one application, the housing, flexible lock, and the end cap of the sealed splice assembly may each be formed from different non-electrical materials as described previously herein. In another application example, the housing, the flexible lock, and the end cover are formed of the same non-electrical material. Dependent on application of use, the artesian may have the liberty to select the material to mold the housing having the least amount of cost.

A seal plug 60 is disposed in housing 20 in cavity 28 intermediate end cover 70 and strip 44 of flexible lock 40. Seal plug 60 has a shape that corresponds to the shape of opening 32. Plug 60 is formed of a solid, yet resilient and pliable, silicone, or silicon-based material, or any material that has similar properties to that of silicon-based materials. Plug 60 defines at least one aperture 63*a-b* therethrough. Plug 60 is installed into housing 20 so that at least one aperture 63*a-b* of seal plug 60 sealingly attaches to at least one post 42 of lock 28. As posts 42*a-b* are inserted in apertures 63*a-b*, apertures 63*a-b* surroudingly sealingly engage, or grab against posts 42*a-b*. Mating apertures 63*a-b* of seal plug 60 into posts 42*a-b* ensures plug 60 is effectively aligned to fit opening 32 and be installed in cavity 28 so that a perimeter surface 64 of plug 60 engagingly fits against an interior surface of housing 20 surrounding perimeter surface 64 of plug 60. Perimeter surface 64 further includes rib-type structures 66 that protrude outwardly away from perimeter surface 64 of plug 60 towards interior surface of housing 20 to ensure a compression fit of plug 60 with the interior surface of housing 20. Preferably, at least two rib-type structures are desired. Alternately, any other structure that provides an effective seal of the plug against the interior surface of the housing may be used.

Plug 60 also includes a plurality of distinct cable holes 65*a-d* therethrough. Cavity 28 receives female terminals 18*a-d* through an elongate hole 76 defined in end cover 70 and respective cable holes 65*a-d* in plug 60 that connect with corresponding extensions 38 of bus plate 34 in cavity 28. Thus, elongate hole 76 is in general alignment with cable holes 65*a-d* along axis A when end cover 70 is attached to housing 20. Elongate hole 76 is defined to include grooved index features. These grooved index features allow the individual, respective female terminals 18*a-d* to be freely and guidingly inserted in to assembly 10 through elongate hole 76 without restriction in a proper orientation. The grooved index features also aid to provide mechanical strain relief for the individual wire conductors 16 when terminals 18 are inserted in cavity 28. Elongate hole 76 is sufficiently sized so that bending of wire conductor 16 is limited adjacent end cover 70 so as to provide additional mechanical strain relief for respective terminals 18*a-d* and wire conductors 16*a-d*. Referring to FIG. 3, respective cable holes 65*a-d* are sufficiently sized so that seal plug 60 surrounding each cable hole 65*a-d* individually surroudingly sealingly engages and grabs against a respective wire conductor 16*a-d* of a respective associated terminal 18*a-d* that is inserted all the way through cable hole 65*a-d* and received in cavity 32. Preferably, terminals 18 have a terminal geometry that allows cable holes 65*a-d* to not be impaired or damaged in a manner that may undesirably affect the sealing of cable holes 65*a-d* against wire conductor 16 when terminals 18 are inserted through at least one of cable holes 65*a-d* into cavity 28. Thus, the size of the distinct cable holes 65*a-d* is based on the AWG size of the wire conductor so that each respective wire conductor 16*a-d* is fitted appropriately, yet sealingly engagable in cable holes 65*a-d* in assembly 10. Posts 42 are also sized in relation to apertures 63 to provide the sealing benefits similar to cable holes 65*a-d*. Enclosed housing 20 in combination with the sealing features of seal plug 60 disposed in opening 32 prevent environment element intrusion into cavity 28. The sealing nature of rib-type structures 66, cable holes 65, and apertures 63 against the interior of housing 20, wire conductors 16, and posts 42, respectively, prevent environmental element leak paths through opening 32. And preventing environmental element intrusion in cavity 28 ensures optimal electrical performance of the electrical connections of terminals 18 with bus plate 34 in sealed splice assembly 10.

Turning our attention back to FIG. 3, housing 20 includes a plurality of housing sections 80 that include a first housing section 80*a*, a second housing section 80*b*, a third housing section 80*c*, and a fourth housing section 80*d*, and a fifth housing section 80*e*. Fifth housing section 80*e* is adjacent opening 20. Each housing section in plurality of housing sections 80*a-e* has a different height. Each housing section in subsequent numerical order from first housing section 80*a* to fifth housing section 80*e* has an increased height over a respective prior housing section. Bus plate 34 is disposed in first and second housing section 80*a*, 80*b*. Plurality of terminals 18*a-d* are disposed substantially in second and third housing section 80*b*, 80*c*. Flexible lock 40 is disposed substantially in third housing section 80*c*. Plug 60 is disposed substantially in fourth housing section 80*d* with a portion of flexible lock 40 being disposed in fifth housing section 80*e*. End cover 70 is at least partially disposed in fifth housing section 80*e* covering opening 20. The varied heights of the first, second, third, fourth, and fifth housing sections 80*a-e* allow for the housing 20 to be molded using simple, cost effective tooling that avoids the use of complex molds that increase manufacturing costs of assembly 10. Alternately, the housing may be constructed in any shape so as to be effectively sealed by the seal plug and the opening be covered by the end cover.

Figure 5A:
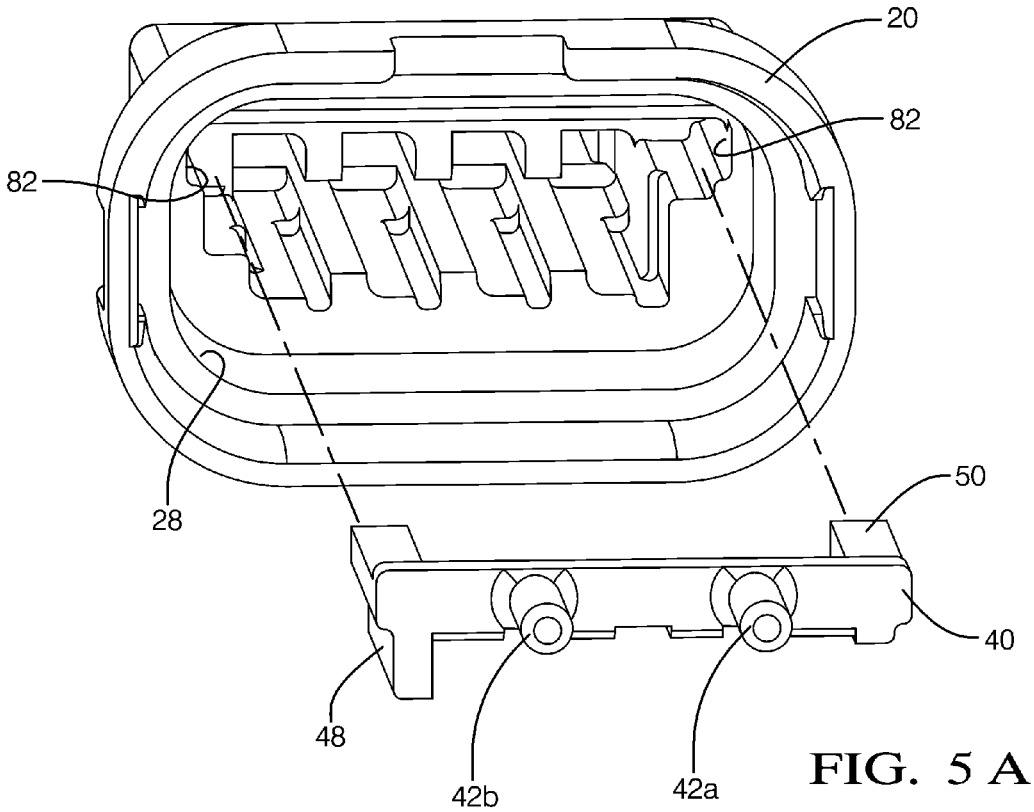
FIG. 5A shows an exploded view of the flexible lock being fitted into an opening of the sealed splice assembly of FIG. 1.
Figure 5B:
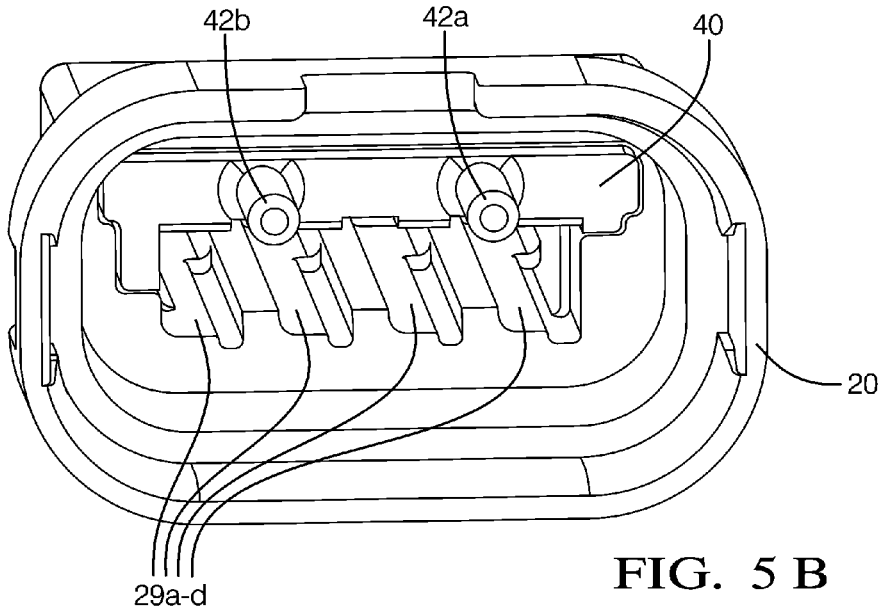
FIG. 5B shows the flexible fitted into a cavity of the sealed electrical splice assembly of FIG. 5A.

Assembly 10 is constructed before, or ahead of being used during the construction of cable harness 12. Assembled sealed splice assembly 10 is best illustrated in FIG. 2, but without wire conductors 16*a-d* and terminals 18*a-d* being installed in assembled splice assembly 10. When sealed splice assembly 10 is constructed, bus plate 34 is press-fit into cavity 28 adjacent closed end 30. Flexible lock 40 is inserted in nested portions 82 of cavity 28 that are slightly larger that respective walls 48, 50 and receive walls 48, 50 of lock 40 so that flexible lock 40 is inserted a single insertion orientation in cavity 28, as best illustrated in FIGS. 5A and 5B. This feature is useful to save time to construct assembly 10. Seal plug 60 is inserted and fitted in cavity 28 where apertures 63*a-b* of seal plug 60 align on posts 42*a-b* of flexible lock 40. As seal plug 60 is inserted in cavity 28 to be disposed on posts 42*a-b*, rib-type structures 66 along perimeter surface 64 of seal plug 60 sealingly engage against the interior surfaces of housing 20 surrounding seal plug 60 in cavity 28. End cover 70 is disposed over opening 32 where tabs 72 of end cover 70 engage housing 20 and flex into shoulders 31 on housing 20 to secure end cover 70 to housing 20. Preferably, assembly 10 is assembled by a human assembler (not shown). Alternately, the sealed splice assembly may be assembled in an automated assembly process.

Referring to FIG. 2, when assembly 10 is not being used, no terminals 18*a-d* attached to wire conductors 16*a-d* of cable harness 12 are inserted in to cavity 32 of assembly 10. When cavity 28 is devoid of terminals 18*a-d*, terminals 18*a-d* are not electrically connected and spliced together.

Figure 6:
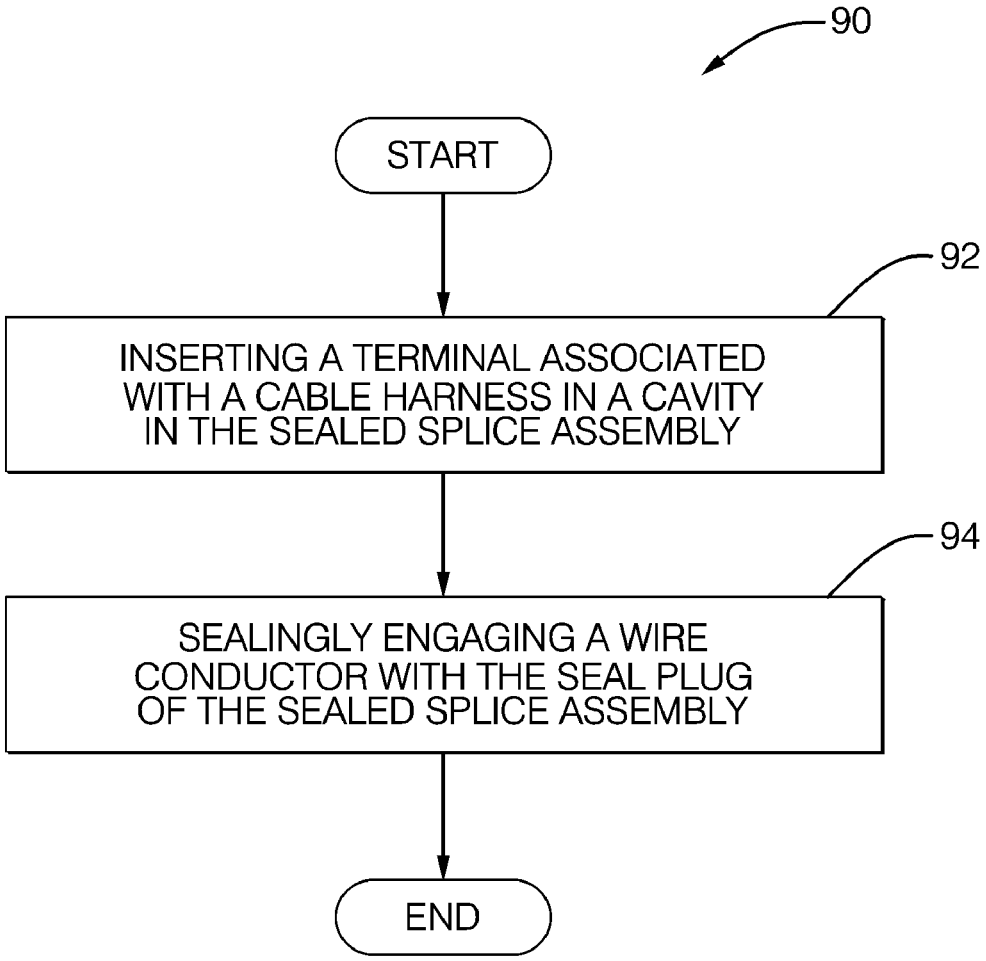
FIG. 6 shows a flow chart of a method to fabricate a sealed electrical splice assembly of FIG. 2 with a cable harness.

When sealed splice assembly 10 is needed for an electrical spiced required in cable harness 12, assembly 10 is installed, or assembled to cable harness 12. For installation of assembly 10 to cable harness 12, a female terminal 18*b* extending from cable harness 12 is inserted along mating axis A into hole 76 of end cover 70 and through one of cable holes 65*b* of seal plug 60 into cavity 28. Referring to FIGS. 3 and 6, this is step 92 in a method 90. Continued insertion of female terminal 18*b* urges female terminal 18*b* along terminal portion 29*b* until female terminal 18*b* engages and electrically and mechanically connects with extension 38*b* of bus plate 34. Extension 46*b* of flexible lock 40 is latched into recess 21 of female terminal 18*b* to secure female terminal 18*b* in cavity 28 of assembly 10. The insulated portion of wire conductor 16*b* rearward, or aft of terminal 18*b* is sealingly engaged by core hole 65*b* such that core hole 65*b* sealingly engages against the insulated portion of wire conductor 65*b*. This is step 94 in method 90. Other terminals 18*a, c-d* of cable harness 12 that need electrical splicing with female terminal 18*b* at bus plate 34 are inserted into assembly 10 along corresponding terminal portions 29*a, c-d* to connect with other extensions 38*a, c-d* of bus plate 34 and extensions 46*b-d* of flexible lock 40 in a similar manner as female terminal 18*b*, as described above herein.

Alternately, the splice assembly may be sized to accommodate any number of terminals using any needed for electrical splicing. In another alternate embodiment the grooved index features defined in the end cover may not be utilized.

In a further alternate embodiment, a range of wire conductor sizes may be inserted into the same sealed splice assembly. For example, if the sealed splice assembly is sized to fit a median wire conductor size of 16 AWG, the terminal slots in the sealed splice assembly may fit and accommodate wire conductors having a range from 18 to 22 AWG due to the built-in manufacturing tolerances of the sealed splice assembly.

In another alternate embodiment, any cable hole in the seal plug that does not receive a terminal may be sealed in any known way as is understood in the connection art. For example, this may be with a corresponding silicone plug that fits the core hole.

In yet a further alternate embodiment, the terminals on the cable harness received by the sealed splice assembly may be male terminals that mate with extensions on the bus plate that are female extensions.

In another alternate embodiment, the extensions of the flexible lock may be configured to engage terminals in the cavity of the sealed splice assembly other than female box terminals. An illustration by way of example and not limitation, these alternate terminals may include other types of female terminals. This may also include male terminals inserted into the sealed splice assembly that interface with a female-type bus plate extension. When a different terminal is used for insertion into the sealed splice assembly, a different flexible lock to secure this different terminal may also be required in the cavity.

In yet a further alternate embodiment, the sealed splice assembly may be configured such that the electrical splicing may be constructed to receive terminals from a first axial direction and a second axial direction where the first axial direction opposes the second axial direction. This type of configuration would require a second end cover and also raises the probability of environmental exposure to the electrical connections disposed in the sealed splice assembly. For example, a bus strip would require a plurality of bus plate extensions similar to the single row of bus bar extensions described in the embodiment of FIGS. 1-6 on both sides of the strip and the housing would require two internal cavities. Thus, the geometry of the housing would need to accommodate the two axially-spaced rows of bus plate extensions. Assembly of sealed splice assembly having this type of arrangement would be similar to the sealed splice assembly of the embodiment in FIGS. 1-6, as described herein.

In yet another alternate embodiment, multiple bus plates may be installed in the cavity for multiple, distinct electrical splices in the same sealed splice assembly. By way of example and not limitation, a pair of bus plates may be utilized with each bus plate in the pair having two extensions. The cavity may be further configured so that the pair of bus plates do not electrically contact with each other when the pair of bus plates are disposed in the cavity.

Alternately, the sealed splice assembly may consist of a plurality of sealed splice assemblies that are electrically connected with a cable harness in a decentralized manner in the vehicle. Thus, the sealed splice assembly may be connected with wire assemblies where the sealed splice assembly needs to be physically located and disposed in the application.

In a further alternate embodiment, the sealed splice assembly is used with cable harnesses used in the motorized transportation industry, such as the trucking or airline industry. Still yet alternately, the sealed splice assembly may be used in any wiring application that requires an environmentally protected sealed splice connection.

In still yet a further alternate embodiment, the elongate hole defined in the end cover may be defined as distinct holes that also include the grooved index features. The distinct holes of the end plate generally align with the distinct cable holes defined in the resilient seal plug along the mating axis. Generally, the distinct holes of the end plate have a larger diameter than the corresponding cable holes of the seal plug so that the terminals are still freely insertable in the holes of the end plate without encountering restriction enroute through the cable holes of the seal plate for disposal in the cavity of the sealed splice assembly.

Thus, a decentralized, reliable sealed electrical splicing assembly is provided that is compact, light weight, and low cost. The sealed splice assembly may be used anywhere electrical splicing of wire conductors is needed, especially where the sealed splice assembly is physically disposed in an environment subject to the environmental elements. The sealed splice assembly is constructed prior to the manufacture of a cable harness. When the cable harness is manufactured, sealed splice assembly is assembled to the cable harness by only inserting terminals of the cable harness into the splice assembly so that the cable holes in the sealed slice assembly sealingly engage against the wire conductor to effectively seal in the terminal and exposes lead of the wire conductor in the cavity of the sealed splice assembly. The terminals are secured in the cavity by a flexible lock disposed in the cavity. The bus plate dutifully receives the inserted terminals of the cable harness to facilitate the robust electrical splice. The seal plug is sized to sufficiently fit in an opening in the cavity and sealingly engage an interior surface of the housing surrounding the seal plug by being aligned on posts of the flexible lock. The distinct cable holes defined in the seal plug are sized to effectively sealingly engage the wire conductor attached to an inserted terminal received into the cavity. Distinct apertures defined in the seal plug are sized to effectively sealingly engage the posts of the flex lock while effectively aligning the seal plug in the opening. The posts on the flexible lock also serve to align the seal plug in the cavity to further ensure the seal plug consistently sealingly engages the interior surface of the housing surrounding the seal plug. The elongate hole aligned with the cable holes in the seal plug is effective to provide mechanical relief for the wire conductor and the terminal attached to the wire conductor inserted in the sealed splice assembly. The housing of the sealed electrical splice assembly includes housing sections each having a different height to allow easy molding of the housing. The different heights of the housing further allow for easy removal of the housing from the mold. Exterior axial walls of the flexible lock have different heights to provide a keyed insertion of the flexible lock into the cavity in a single orientation.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A splice assembly comprising:

an insulative, non-electrically conductive housing defining a cavity and including an opening;

an electrically conductive bus plate retained in the cavity;

a plurality of electrically conductive terminals disposed in the cavity and electrically connected to the bus plate, said plurality of terminals being electrically connected to a plurality of wire conductors;

a flexible lock received in the cavity of the housing;

a seal plug being disposed in the cavity and configured to fittingly communicate with the flexible lock such that the fitted sealing plug is adapted to sealingly engage an interior surface of the housing surrounding the disposed seal plug, the received flexible lock being configured to retain said plurality of terminals received in the cavity; and an end cover disposed in the opening overlying the seal plug, wherein the cavity receives the plurality of terminals through the end cover and the seal plug so that the seal plug sealingly engages against the plurality of wire conductors.

2. The sealed splice assembly of claim 1, wherein the seal plug comprises a resilient seal plug, and said resilient seal plug defines a plurality of cable holes and the end cover defines an elongate hole that generally overlies the plurality of cable holes when the end cover is attached to the assembly so that the plurality of terminals are freely inserted through the elongate opening and all the way through the plurality of cable holes and disposed in the cavity such that the resilient seal plug surrounding each cable hole in the plurality of cable holes surroundingly sealingly engages against each wire conductor in the plurality of wire conductors.

3. The sealed splice assembly of claim 1, wherein the flexible lock includes a strip and a plurality of longitudinal flexible lock extensions that extend away from the strip, each extension in the plurality of lock extensions being configured to independently retain a terminal in the plurality of terminals in the cavity when said terminal is received in to the cavity and electrically connected to the bus plate.

4. The sealed splice assembly of claim 1, wherein said flexible lock comprises a plurality of longitudinal extending walls having different heights so that the flexible lock is keyed to fit in the cavity in a single orientation.

5. The sealed splice assembly of claim 1, wherein the housing includes, a plurality of housing sections, each housing section in the plurality of housing sections having a different height.

6. The sealed splice assembly of claim 1, wherein the bus plate comprises a planar bus plate, and the planer bus plate includes a strip and a plurality of cantilevered, spaced extensions that extend from said strip into the cavity, said plurality of terminals electrically connect to said corresponding plurality of extensions.

7. A sealed electrical splice assembly comprising:

an insulative, non-electrically conductive housing defining a cavity and including an opening;

an electrically conductive bus plate retained in the cavity;

a plurality of electrically conductive terminals disposed in the cavity and electrically connected to the bus plate, said plurality of terminals being electrically connected to a plurality of wire conductors;

a seal plug being disposed in the cavity and adapted to sealingly engage an interior surface of the housing surrounding the disposed seal plug;

an end cover disposed in the opening overlying the seal plug;

a flexible lock disposed adjacent the seal plug in the cavity and adapted to retain the plurality of terminals received in the cavity, wherein the cavity receives the plurality of terminals through the end cover and the seal plug so that the seal plug sealingly engages against the plurality of wire conductors, and wherein the flexible lock includes at least one post extending away from a surface of the flexible lock toward the opening, the seal plug being adapted for attachment to the at least one post thereon to align the seal plug in the cavity therein.

8. A sealed electrical splice assembly comprising:

an insulative, non-electrically conductive housing defining a cavity and including an opening;

an electrically conductive bus plate retained in the cavity;

a plurality of electrically conductive terminals disposed in the cavity and electrically connected to the bus plate, said plurality of terminals being electrically connected to a plurality of wire conductors;

a seal plug being disposed in the cavity and adapted to sealingly engage an interior surface of the housing surrounding the disposed seal plug; and an end cover disposed in the opening overlying the seal plug, wherein the cavity receives the plurality of terminals through the end cover and the seal plug so that the seal plug sealingly engages against the plurality of wire conductors, and wherein the housing includes, a plurality of housing sections, each housing section in the plurality of housing sections having a different height, and wherein the plurality of sections include, a first housing section, a second housing section, a third housing section, a fourth housing section and a fifth housing section, said fifth housing section being adjacent the opening, wherein each housing section in subsequent numerical order from the first housing section to the fifth housing section has an increased height over a respective prior housing section, and said bus plate being disposed in the first and the second housing section, said plurality of terminals being disposed substantially in the second and the third housing section, said flexible locks being disposed substantially in the third and the fourth housing section, said seal plug being disposed substantially in the fourth housing section, and said end cover being at least partially disposed in the fifth housing section.

9. A method to fabricate a sealed electrical splice assembly associated with a cable harness, comprising:

fitting a flexible lock and an electrically conductive bus plate, respectively, in to a cavity defined in a housing of the sealed splice assembly;

inserting a plurality of terminals in the cavity that electrically connect to said bus plate, the plurality of terminals being attached to a plurality of wire conductors associated with the cable harness, and a seal plug is received by the flexible lock thereon so that the seal plug is sealingly engaged against an interior surface of the housing surrounding the seal plug disposed in the cavity; and sealingly engaging the plurality of wire conductors with the seal plug when the plurality of terminals are disposed in the cavity and are in locked communication with the flexible lock.

10. The method according to claim 9, wherein the steps in the method further include where the seal plug comprises a resilient seal plug, and said resilient seal plug defines a plurality of cable holes and the end cover defines an elongate hole that generally overlies the plurality of cable holes when the end cover is attached to the assembly so that the plurality of terminals are freely inserted through the elongate opening and all the way through the plurality of cable holes and disposed in the cavity such that the resilient seal plug surrounding each cable hole in the plurality of cable holes surroundingly sealingly engages against each wire conductor in the plurality of wire conductors.

11. The method according to claim 9, further including, mechanically securing each terminal in the plurality of terminals within the cavity by a flexible lock to retain said plurality of terminals in the cavity.

12. The method according to claim 11, wherein the step of securing each received plurality of terminals within the cavity further includes the flexible lock having a strip and a plurality of longitudinal flexible lock extensions depending away from the strip, each extension configured to independently retain a terminal in the plurality of terminals in the cavity.

13. The method according to claim 9, wherein the steps in the method further include where the cable harness comprises a cable harness used in a vehicle, and the vehicular cable harness comprises at least one sealed electrical splice assembly.

14. The method according to claim 9, wherein the steps in the method further include the housing composing a plurality of housing sections, each housing section in the plurality of housing sections having a different height.

15. A sealed electrical splice assembly comprising:

an insulative housing having longitudinally extending side walls with a floor and top wall extending therebetween and ends that combine to define a cavity, one of the ends being a closed end and another one of the ends being an open end, and the housing including, an end cover overlying the opening, a seal plug disposed in the cavity adjacent the end cover being in sealing communication with an interior surface of the housing surrounding the seal plug, a electrically conductive bus plate disposed in the cavity, a plurality of terminals in electrical connection with a plurality of wire cables, the plurality of terminals being received in the cavity being in electrical connection with the bus plate, a flexible lock being received in the cavity and configured to secure the received plurality of terminals thereto, said plurality of terminals being received into the cavity through the end cover and the seal plug such that the seal plug sealingly engages against the plurality of wire cables disposed therein, wherein said housing comprises a plurality of longitudinal extending walls having different heights in the cavity so that the flexible lock is keyed to fit in said plurality of longitudinal extending walls in a single orientation.

16. The sealed splice assembly of claim 15, wherein the flexible lock includes a strip and a plurality of longitudinal flexible lock extensions depend away from the strip, each extension in the plurality of lock extensions being configured to independently retain a terminal in the plurality of terminals when said terminal is received in to the cavity and electrically connected to the bus plate.

17. The sealed splice assembly of claim 15, wherein the housing includes, a plurality of housing sections, each housing section in the plurality of housing sections having a different height.

18. A sealed electrical splice assembly comprising:

an insulative housing having longitudinally extending side walls with a floor and top wall extending therebetween and ends that combine to define a cavity, one of the ends being a closed end and another one of the ends being an open end, and the housing including, an end cover overlying the opening, a seal plug disposed in the cavity adjacent the end cover being in sealing communication with an interior surface of the housing surrounding the seal plug, a electrically conductive bus plate disposed in the cavity, a plurality of terminals in electrical connection with a plurality of wire cables, the plurality of terminals being received in the cavity being in electrical connection with the bus plate, a flexible lock that secures the received plurality of terminals in the cavity therein where said plurality of terminals are received into the cavity through the end cover and the seal plug such that the seal plug sealingly engages against the plurality of wire cables disposed therein, wherein the flexible lock includes at least one post extending away from a surface of the flexible lock towards the opening, and the seal plug is adapted for attachment to the at least one post thereon to align the seal plug in the cavity therein.

* * * * *